US011201047B2

(12) United States Patent
Oshiro et al.

(10) Patent No.: US 11,201,047 B2
(45) Date of Patent: Dec. 14, 2021

(54) TIME-OF-FLIGHT MASS SPECTROMETER

(71) Applicant: SHIMADZU CORPORATION, Kyoto (JP)

(72) Inventors: Tomoyuki Oshiro, Kyoto (JP); Yoshikatsu Umemura, Kyoto (JP); Kazuma Maeda, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 17/052,570

(22) PCT Filed: May 14, 2018

(86) PCT No.: PCT/JP2018/018536
§ 371 (c)(1),
(2) Date: Nov. 3, 2020

(87) PCT Pub. No.: WO2019/220501
PCT Pub. Date: Nov. 21, 2019

(65) Prior Publication Data

US 2021/0242008 A1 Aug. 5, 2021

(51) Int. Cl.
*H01J 49/42* (2006.01)
*H01J 49/00* (2006.01)
(Continued)

(52) U.S. Cl.
CPC ..... *H01J 49/4215* (2013.01); *H01J 49/0031* (2013.01); *H01J 49/0045* (2013.01);
(Continued)

(58) Field of Classification Search
CPC .. H01J 49/4215; H01J 49/0031; H01J 49/022; H01J 49/063; H01J 49/165;
(Continued)

(56) References Cited

U.S. PATENT DOCUMENTS 8,754,367 B2 * 6/2014 Kou ..... H01J 49/0031 250/287
2013/0313421 A1 11/2013 Taniguchi
(Continued)

FOREIGN PATENT DOCUMENTS

JP 2003-123686 A 4/2003
JP 2013-247000 A 12/2013
WO 2018/020600 A1 2/2018

OTHER PUBLICATIONS

International Search Report of PCT/JP2018/018536 dated Jul. 3, 2018 [PCT/ISA/210].
(Continued)

*Primary Examiner* — Kiet T Nguyen
(74) *Attorney, Agent, or Firm* — Sughrue Mion, PLLC

(57) ABSTRACT

To acquire a mass spectrum for a wide mass range, a normal analysis execution controlling unit controls components to repeatedly perform measurement while changing setting m/z by a predetermined m/z at a time, and a mass spectrum summarizing processing unit summarizes data pieces each obtained by each time of measurement to generate the mass spectrum. Radio-frequency voltage applied to an ion guide and the like is changed based on the setting m/z. The radio-frequency voltage for the setting m/z is determined using a table in which a relationship between a position on an axis between upper and lower limits of the mass range and the radio-frequency voltage is substantially the same regardless of the mass range.

5 Claims, 4 Drawing Sheets

(51) Int. Cl.

| | |
|---|---|
| ***H01J 49/02*** | (2006.01) |
| ***H01J 49/06*** | (2006.01) |
| ***H01J 49/16*** | (2006.01) |
| ***H01J 49/40*** | (2006.01) |

(52) U.S. Cl.
CPC ..... *H01J 49/022* (2013.01); *H01J 49/062* (2013.01); *H01J 49/063* (2013.01); *H01J 49/165* (2013.01); *H01J 49/401* (2013.01); *H01J 49/429* (2013.01)

(58) Field of Classification Search
CPC ..... H01J 49/401; H01J 49/429; H01J 49/40; H01J 49/0045; H01J 49/062
USPC ..... 250/287, 281
See application file for complete search history.

(56) References Cited

U.S. PATENT DOCUMENTS

| | | | | |
|---|---|---|---|---|
| 2016/0329197 | A1* | 11/2016 | Yamaguchi ..... | H01J 49/40 |
| 2019/0162697 | A1 | 5/2019 | Okumura | |

OTHER PUBLICATIONS

Written Opinion of PCT/JP2018/018536 dated Jul. 3, 2018 [PCT/ISA/237].

* cited by examiner

Fig. 2A

RADIO FREQUENCY PARAMETER TABLE FOR MEASUREMENT MASS RANGE m/z 10 TO 600

| SETTING m/z | ION GUIDE A | ION GUIDE B | ION GUIDE C |
|---|---|---|---|
| 100 | 22 | 30 | 25 |
| 200 | 44 | 60 | 50 |
| 300 | 66 | 90 | 75 |
| 400 | 88 | 120 | 100 |
| 500 | 110 | 120 | 100 |
| 600 | 110 | 120 | 100 |

Fig. 2B

RADIO FREQUENCY PARAMETER TABLE FOR MEASUREMENT MASS RANGE m/z 10 TO 2000

| SETTING m/z | ION GUIDE A | ION GUIDE B | ION GUIDE C |
|---|---|---|---|
| 333.3 | 22 | 30 | 25 |
| 666.7 | 44 | 60 | 50 |
| 1000 | 66 | 90 | 75 |
| 1333.3 | 88 | 120 | 100 |
| 1666.7 | 110 | 120 | 100 |
| 2000 | 110 | 120 | 100 |

Fig. 3

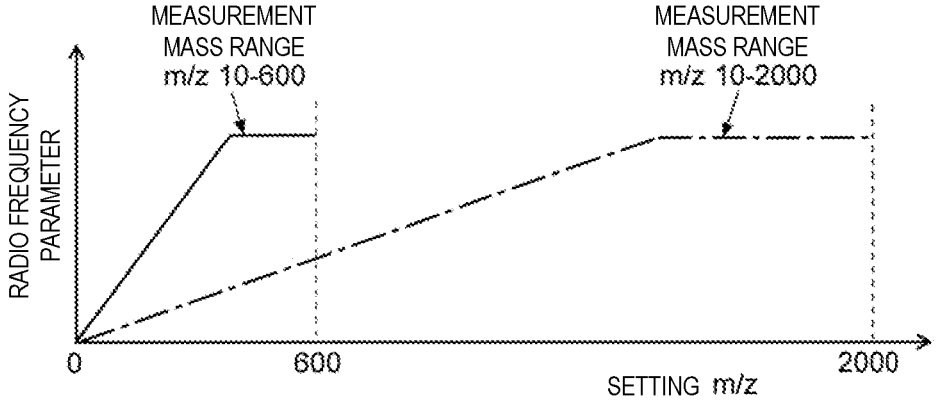

Fig. 4A

RADIO FREQUENCY PARAMETER TABLE FOR MEASUREMENT MASS RANGE m/z 10 TO 600

| SETTING m/z | ION GUIDE A | ION GUIDE B | ION GUIDE C |
|---|---|---|---|
| 100 | 22 | 30 | 25 |
| 200 | 44 | 60 | 50 |
| 300 | 66 | 90 | 75 |
| 400 | 88 | 120 | 100 |
| 500 | 110 | 120 | 100 |
| 600 | 110 | 120 | 100 |

Fig. 4B

RADIO FREQUENCY PARAMETER TABLE FOR MEASUREMENT MASS RANGE m/z 10 TO 2000

| SETTING m/z | ION GUIDE A | ION GUIDE B | ION GUIDE C |
|---|---|---|---|
| 100 | 22 | 30 | 25 |
| 200 | 44 | 60 | 50 |
| 300 | 66 | 90 | 75 |
| 400 | 88 | 120 | 100 |
| 500 | 110 | 120 | 100 |
| 2000 | 110 | 120 | 100 |

TIME-OF-FLIGHT MASS SPECTROMETER

CROSS REFERENCE TO RELATED APPLICATIONS

This application is a National Stage of International Application No. PCT/JP2018/018536 filed on May 14, 2018.

TECHNICAL FIELD

The present invention relates to a time-of-flight mass spectrometer (hereinafter, referred to as "TOFMS" if appropriate), and more particularly relates to a TOFMS that transports ions, derived from a sample component generated by an ion source, to an ion ejecting unit through an ion guide using a radio-frequency electric field and ejects the ions into a flight space from the ion ejecting unit for performing mass spectrometry. The TOFMS according to the present invention is particularly suitable for an orthogonal acceleration TOFMS (hereinafter, referred to as "OA-TOFMS" if appropriate).

BACKGROUND ART

A quadrupole-time-of-flight (hereinafter referred to as "Q-TOF") mass spectrometer has been known as one type of mass spectrometer. A Q-TOF mass spectrometer disclosed in Patent Literature 1, for example, includes: an ion source that performs ionization by electrospray ionization (ESI); a quadrupole mass filter for selecting ions with a certain mass-to-charge ratio m/z; a collision cell that dissociates the selected ions by collision-induced dissociation (CID); and an OA-TOFMS including an orthogonal acceleration unit. The Q-TOF mass spectrometer dissociates ions derived from components in a sample, and acquires mass spectrum with high accuracy and high resolution for product ions generated through the dissociation of the ions derived from the components in the sample. Thus, MS/MS (=$MS^2$) analysis is performed.

In the above Q-TOF mass spectrometer, an ion guide utilizing an ion focusing effect provided by a radio-frequency electric field is used, so that the ions generated under substantially atmospheric pressure can be efficiently transported to the quadrupole mass filter located in a vacuum chamber. The collision cell also incorporates an ion guide utilizing the ion focusing effect provided by a radio-frequency electric field. Furthermore, when the Q-TOF mass spectrometer performs normal mass spectrometry (what is known as $MS^1$ analysis) without dissociating ions in the collision cell, instead of the MS/MS analysis, the quadrupole mass filter simply functions as the ion guide utilizing the ion focusing effect provided by a radio-frequency electric field.

As described above, when the normal mass spectrometry is performed with the Q-TOF mass spectrometer, ions generated by the ion source are introduced into the orthogonal acceleration unit of the OA-TOFMS via a plurality of ion guides, and the mass spectrometry is performed with the OA-TOFMS. In the ion guide utilizing a radio-frequency electric field, the ions travel while oscillating due to the interaction between the electric charge of the ions and the electric field. The magnitude of the oscillation depends on the mass-to-charge ratio of the ions and the magnitude (amplitude) of radio-frequency voltage applied to the ion guide. Therefore, a range of the mass-to-charge ratio of the ions that can pass through the ion guide depends on the magnitude of the radio-frequency voltage applied to the ion guide. Thus, if the amplitude of the radio-frequency voltage applied to the ion guide is fixed, the mass-to-charge ratio range of the ions that can pass through the ion guide is limited, meaning that a mass spectrum over a wide mass-to-charge ratio range is difficult to achieve.

In this respect, the following method has been known for obtaining a mass spectrum ($MS^1$ spectrum) over a wide mass-to-charge ratio range. Specifically, measurement is executed for a plurality of times while changing the magnitude of the radio-frequency voltage applied to the ion guide, and mass spectra corresponding to different mass-to-charge ratio ranges obtained by the plurality of times of measurement are summarized.

FIGS. 7A and 7B illustrate a relationship between a respective mass spectrum obtained at each time of measurements under respective setting m/z and a total mass spectrum summarized after all time measurements, in a case where each mass spectrum is obtained with a mass range of m/z 10 to 600 and a case where each mass spectrum is obtained with a wider mass range of m/z 10 to 2000. Here, "mass range" is a range set for an ion guide as a range of mass-to-charge ratio for passing ions through the ion guide, and "setting m/z" is a point on the mass-to-charge ratio scale at which a value of a parameter of the ion guide is set when the value of the parameter is changed according to mass-to-charge ratio of ions that should be passed through the ion guide. In FIGS. 7A and 7B, each mass spectrum (hereinafter, referred to as "partial mass spectrum" to be distinguished from a mass spectrum over the entire mass range) is obtained while increasing the setting m/z by 50 at a time within the mass-to-charge ratio range of the mass range. Then, a plurality of partial mass spectra obtained over the entire mass range are summarized to obtain a total mass spectrum corresponding to the entire mass range. As illustrated in FIGS. 7A-7B, the summarizing processing is the same irrespective of the mass range.

CITATION LIST

Patent Literature

Patent Literature 1: WO 2018/020600 A
Patent Literature 2: JP 2013-247000 A

SUMMARY OF INVENTION

Technical Problem

However, the conventional mass spectrum summarizing processing method described above has a problem in that the intensity of peaks of a low mass-to-charge ratio region becomes much lower when the mass range is wide, compared with a case where the mass range is narrow. For example, as illustrated in FIG. 7B, the intensity of the peaks in the low mass-to-charge ratio region indicated by the dotted line in the mass spectrum of the mass range m/z 10 to 2000 is much lower than the intensity of the peak in the same mass-to-charge ratio region in the mass spectrum of the mass range m/z 10 to 600 illustrated in FIG. 7A. In this manner, the sensitivity in the low mass-to-charge ratio region deteriorates when the observation target mass range increases. Thus, there has been a possibility that a user may fail to find a peak appearing in a low mass-to-charge ratio region in the case of the mass spectrum with a wide mass range. With the intensity of the peak thus lowered, there is also a possibility that the user may erroneously determine that the content of a compound that is actually contained in large amount is small. Furthermore, the peak pattern in the same mass-to-charge ratio range varies among different mass ranges, rendering comparison between mass spectra with different mass ranges difficult.

The present invention has been made to solve the problem described above, and an object of the present invention is to provide a TOFMS that repeats the measurement while changing the radio-frequency voltage applied to one or a plurality of ion guides and summarizes partial mass spectra obtained by the respective measurements to generate a mass spectrum of a wider mass-to-charge ratio range, with which lowering of the intensity of the peak in the low mass-to-charge ratio region due to a widened mass range can be suppressed.

Solution to Problem

The present inventors have elucidated the cause of the above problem in the conventional mass spectrum summarizing processing through experiments and studies. An ion guide that transports ions while focusing them by means of a radio-frequency electric field involves a phenomenon known as low-mass cut-off. This is a phenomenon in which ions with a low mass-to-charge ratio are less likely to be stably transported when a depth of a confining potential is increased for the purpose of more effective ion focusing. FIG. 6 is a schematic diagram illustrating normalized values of the intensities of measurement target ions with the respective mass-to-charge ratios of m/z 200, m/z 500, and m/z 800 that pass through an ion guide with respect to setting m/z of the ion guide. For example, the figure indicates that when the setting m/z is about 400 to 600, ions with a mass-to-charge ratio of m/z 200 do not pass at all, and ions with a mass-to-charge ratio of m/z 400 or m/z 800 pass with high efficiency. As described above, the low-mass cut-off characteristics appear quite remarkably depending on the setting m/z. On the other hand, substantially all the ions having a mass-to-charge ratio of m/z 800 can pass with high efficiency with the setting m/z in a range of about 300 to 1150.

When the measurement is repeated while changing the setting m/z as illustrated in FIGS. 7A-7B, the setting m/z is changed linearly, that is, with the same mass-to-charge ratio interval, regardless of whether the mass range is narrow or wide. It may seem that different mass ranges are balanced. However, due to the low-mass cut-off phenomenon, ions in the low mass-to-charge region are actually less likely to be counted in the summarized mass spectrum. Such a detrimental effect worsens as the number of times the partial mass spectrum with a relatively high setting m/z is summarized increases, that is, as the upper limit of the mass range increases. All things considered, repeated measurement while linearly changing the setting m/z in the same manner between cases where the mass range is narrow and wide causes disadvantages in terms of ion detection sensitivity in the low mass-to-charge ratio region. Based on these findings, the present inventors arrived at the idea of performing the measurement multiple times with the setting m/z adjusted so as not to cause disadvantages in terms of ion detection sensitivity in the low mass-to-charge ratio region, and thus completed the present invention.

A time-of-flight mass spectrometer according to the present invention made for solving the problem described above and including an ion source for ionizing a sample component, a time-of-flight mass spectrometry unit including an ion ejecting unit for ejecting ions generated by the ion source or other ions derived from the generated ions into a flight space, and one or a plurality of ion transport optical elements for transporting the ions while focusing the ions by means of a radio-frequency electric field, the one or plurality of ion transport optical elements being provided between the ion source and the ion ejecting unit, further includes:

a) a voltage generating unit for applying radio-frequency voltage for forming a radio-frequency electric field to each of the one or plurality of ion transport optical elements;

b) a controlling unit for determining, in response to a mass range designated as an observation target, a radio-frequency voltage applied to each of the one or plurality of ion transport optical elements in each of a plurality of times of measurement using different measurement target mass-to-charge ratio ranges for acquiring a mass spectrum entirely covering a mass-to-charge ratio range of the mass range, and for controlling components to perform the plurality of times of measurement while changing the radio-frequency voltage applied to each of the one or plurality of ion transport optical elements by the voltage generating unit, the controlling unit determining the radio-frequency voltage for each of the plurality of times of measurement to maintain a ratio of times of measurement in which radio-frequency voltage is set so that ion passage efficiency in a low mass-to-charge ratio region is relatively high among the plurality of times of measurement to be substantially constant regardless of a width of the mass range; and c) a mass spectrum summarizing processing unit for obtaining a mass spectrum corresponding to the mass range by summarizing mass spectrum data pieces obtained by the plurality of respective times of measurement under control by the controlling unit.

In the present invention, typically, a user designates a mass range as an observation target based on the purpose of the analysis or according to the type of an object of the analysis. When the mass range is designated, the controlling unit determines radio-frequency voltage applied to each ion transport optical element in each of a plurality of times of measurement with different mass-to-charge ratio ranges of a measurement target, for obtaining a mass spectrum entirely covering the mass-to-charge ratio range of the mass range. As described before, the mass-to-charge ratio range of ions that can be stably focused changes when the magnitude (amplitude) of the radio-frequency voltage changes. Thus, the radio-frequency voltage needs to be appropriately determined based on the mass-to-charge ratio range of the measurement target. The controlling unit determines the radio-frequency voltage to maintain, among a plurality of times of measurement, the ratio of times of measurement in which radio-frequency voltage is set so that ion passage efficiency in the low mass-to-charge ratio region is relatively high to be substantially the same between a case where the upper limit of the mass range is high and a case where the upper limit of the mass range is low.

As described above, in the conventional mass spectrum summarizing processing method, a higher upper limit of the mass range leads to a lower sensitivity in a low mass-to-charge region due to the low mass cutoff phenomenon, resulting in the region being underestimated. Thus, the intensity of ions in this region is less likely to be involved in the mass spectrum after the summarizing. On the other hand, in the present invention, as described above, when the upper limit of the mass range is high, that is, when the mass range is wide, the ratio of measurement in a state with a relatively high ion intensity in the low mass-to-charge ratio region (that is, not cut off by the low-mass cut-off phenomenon, or not significantly cut off by the low-mass cut-off phenomenon) is high. Thus, the ion intensity in the low mass-to-charge ratio region is more likely to be involved in the mass spectrum after the summarizing than in the conventional case. Thus, the deterioration of the sensitivity in the low mass-to-charge ratio region in the mass spectrum after the summarizing by the mass spectrum summarizing processing unit is suppressed.

It is in a sense appropriate for a user to perform a plurality of times of measurement with the setting m/z in the mass-to-charge ratio range of the mass range changed linearly, that is, at an equal mass-to-charge ratio interval as in FIGS. 7A-7B. However, the problem as described above arises when the measurement is performed while changing the setting m/z linearly, using a table (see FIGS. 4A-4B described later) and a formula with which the same radio-frequency voltage is associated with the same setting m/z regardless of the mass range.

Thus, one preferable aspect of the present invention may be a configuration in which the controlling unit determines the radio-frequency voltage based on a table or a formula with which a relationship between a position on an axis between upper and lower limits of the mass range and the radio-frequency voltage is substantially the same between different mass ranges.

With this configuration, a change in the radio-frequency voltage becomes more moderate with a wider mass range, when a plurality of times of measurement are performed while changing the setting m/z by the same mass-to-charge ratio at a time within the mass-to-charge ratio range of the mass range. Thereby, a wide mass range results in a larger weight of the ion intensity in the low mass-to-charge ratio region, whereby the deterioration of sensitivity in the low mass-to-charge ratio region in the mass spectrum after summarizing can be suppressed.

Furthermore, the present invention is, for example, a Q-TOF mass spectrometer.

One embodiment of the present invention may be a configuration in which a quadrupole mass filter capable of selectively allowing ions with a certain mass-to-charge ratio to pass through and a collision cell for dissociating the ions are provided between the ion source and the ion ejecting unit, and the quadrupole mass filter operating without selecting the ions and an ion guide provided in the collision cell respectively serve as one of the one or plurality of ion transport optical elements.

Furthermore, in this configuration, one or a plurality of ion guides provided between the ion source and the quadrupole mass filter may serve as the one or plurality of ion transport optical elements.

Advantageous Effects of Invention

With the present invention, the deterioration of the peak intensity in the low mass-to-charge ratio region, when the observation target mass range is widened, can be suppressed. This results in a higher similarity between peak patterns corresponding to the same mass-to-charge ratio range in the mass spectra with different mass ranges. Thus, comparison between the mass spectra obtained with different mass ranges is facilitated. Furthermore, a failure to find a peak or peaks to be observed in a low mass-to-charge ratio region can be prevented, or the content of a compound the peak of which is observed in the low mass-to-charge ratio region can be prevented from being underestimated.

BRIEF DESCRIPTION OF DRAWINGS

FIGS. 2A-2B are diagrams illustrating an example of a radio-frequency voltage scanning table used in the Q-TOF mass spectrometer according to the present embodiment.

FIG. 3 is a schematic view illustrating a relationship between setting m/z and a radio-frequency voltage parameter in the Q-TOF mass spectrometer according to the present embodiment.

FIGS. 4A-4B are diagrams illustrating an example of a radio-frequency voltage scanning table used in a conventional Q-TOF mass spectrometer.

DESCRIPTION OF EMBODIMENTS

A Q-TOF mass spectrometer, which is an embodiment of the present invention will be described with reference to the accompanying drawings.

Figure 1:
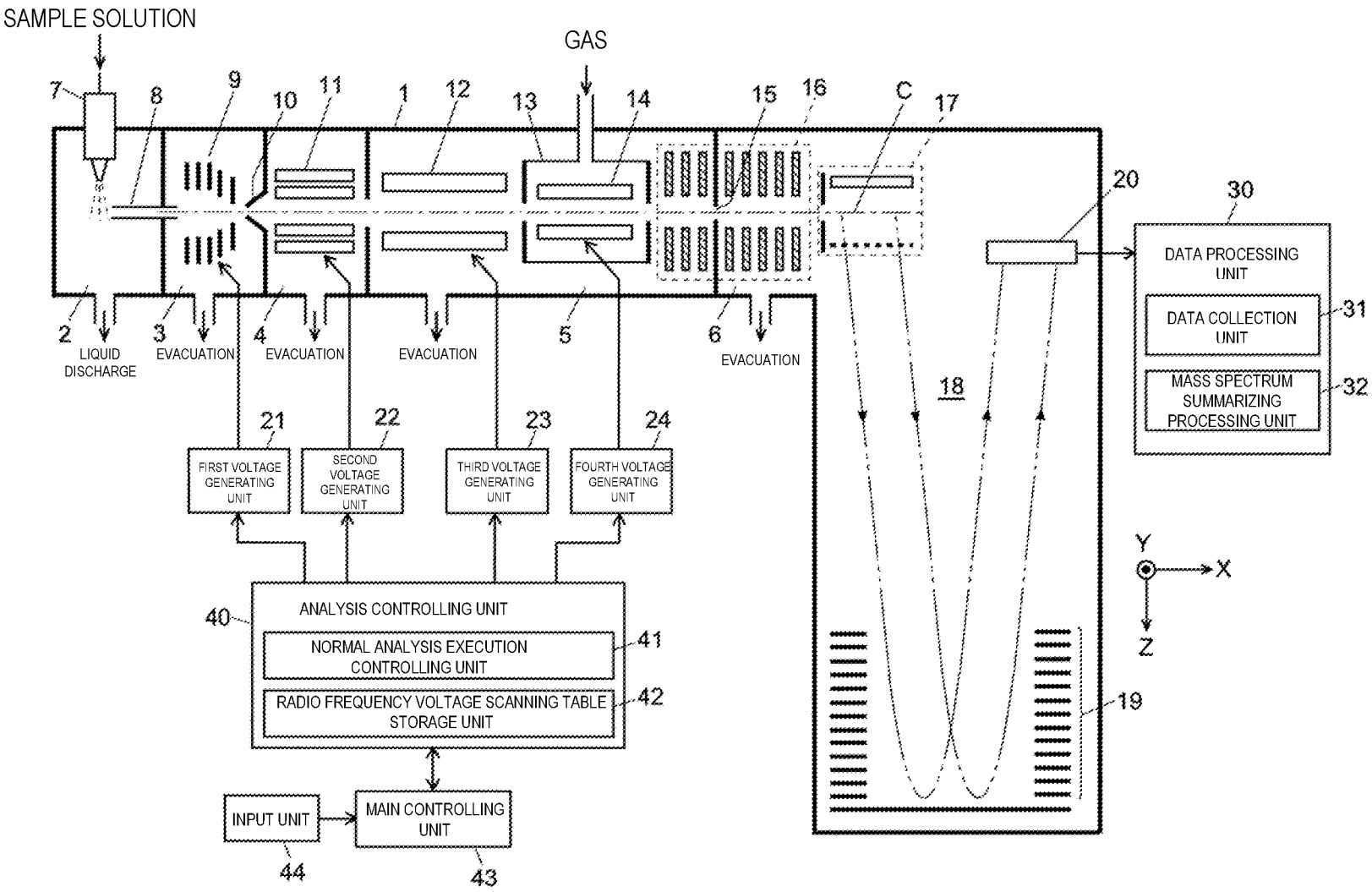
FIG. 1 is a configuration diagram of a main part of a Q-TOF mass spectrometer as one embodiment of the present invention.

FIG. 1 is a configuration diagram of a main part of the Q-TOF mass spectrometer of the present embodiment.

The Q-TOF mass spectrometer of the present embodiment has a configuration of a multi-stage differential evacuation system with a chamber 1 containing an ionization chamber 2 at a substantially atmospheric atmosphere and a second analysis chamber 6 with the highest degree of vacuum, as well as a first intermediate vacuum chamber 3, a second intermediate vacuum chamber 4, and a first analysis chamber 5 with their degree of vacuum increasing in this order from the ionization chamber 2 to the second analysis chamber 6.

The ionization chamber 2 is provided with an electrospray ionization (ESI) spray 7 for performing ionization by ESI. When a sample solution including a target compound is supplied to the ESI spray 7, it is nebulized in charged droplets from the distal end of the spray 7. As the charged droplets split and the solvent evaporates, ions derived from the target compound are generated. The ionization is not limited to this, and other types of ionization such as atmospheric pressure chemical ionization (APCI) and atmospheric pressure photoionization (APPI) may be employed.

The various ions generated in the ionization chamber 2 are sent to the first intermediate vacuum chamber 3 through a heating capillary 8, focused by an array type ion guide 9 provided in the first intermediate vacuum chamber 3, and are sent to the second intermediate vacuum chamber 4 through a skimmer 10. The ions are further focused by a multipole type ion guide 11 provided in the second intermediate vacuum chamber 4, and are then sent to the first analysis chamber 5. The first analysis chamber 5 contains a quadrupole mass filter 12 and a collision cell 13 incorporating an ion guide 14 of a multipole type.

The various ions derived from the sample are introduced into the quadrupole mass filter 12. When MS/MS analysis is performed, ions having a certain mass-to-charge ratio corresponding to the voltage applied to the quadrupole mass filter 12 pass through the quadrupole mass filter 12. The ions are introduced into the collision cell 13 as precursor ions. The precursor ions are dissociated by coming into contact with the collision gas supplied into the collision cell 13. Thus, various product ions are generated. On the other hand, at the time of normal mass spectrometry ($MS^1$ analysis) not involving the ion dissociation, the ions derived from the sample component pass through the quadrupole mass filter 12 almost intact (still, the mass-to-charge ratio range enabling the passage is actually limited as described later) to be introduced into the collision cell 13. Then, the ions come into contact with the collision gas supplied into the collision cell 13 so that their energy is reduced (i.e. cooled).

In the collision cell 13, the ions derived from the sample components are transported while being focused. The ions ejected from the collision cell 13 are introduced into the second analysis chamber 6 through an ion passage port 15 while being guided by an ion transport optical system 16. The second analysis chamber 6 contains an orthogonal acceleration unit 17 serving as an ion ejection portion, a flight space 18 provided with a reflector 19, and an ion detector 20. The ions introduced into the orthogonal acceleration unit 17 in the X axis direction along an ion optical axis C are accelerated in the Z axis direction at a predetermined timing to be ejected. The ejected ions fly freely in the flight space 18 as indicated by the two-dot chain line in FIG. 1, reflected by a reflecting electric field formed by the reflector 19 to fly freely again in the flight space 18, and reach the ion detector 20. The time of flight of the ions between the departure from the orthogonal acceleration unit 17 and the arrival at the ion detector 20 depends on the mass-to-charge ratio of the ions.

A data processing unit 30 includes functional blocks of a data collection unit 31 and a mass spectrum summarizing processing unit 32. The data collection unit 31 receives detection signal from the ion detector 20 and digitizes and accumulates the signal. The mass spectrum summarizing processing unit 32 generates a time-of-flight spectrum based on the collected data, and converts the time of flight into a mass-to-charge ratio to generate a mass spectrum. The mass spectrum summarizing processing unit 32 summarizes partial mass spectra each obtained by one of a plurality of times of measurement, as described later, to generate a mass spectrum of a wider mass-to-charge ratio range.

First to fourth voltage generating units 21 to 24 apply predetermined radio-frequency voltage respectively to the array type ion guide 9, the multipole type ion guide 11, the quadrupole mass filter 12, and the ion guide 14. Furthermore, appropriate DC voltages are also applied to components including these electrodes, but the description of a voltage generating unit for generating such voltages is omitted. Furthermore, predetermined DC voltages are applied other components (such as, for example, the heating capillary 8 and the skimmer 10) but the description of the other components is omitted. Thus, in this document, a description is given only on the components for applying the radio-frequency voltage to ion optical elements having the function of transporting ions while focusing them by means of a radio-frequency electric field, related to the characteristic operation of the apparatus of the present embodiment.

The first to the fourth voltage generating units 21 to 24 are each controlled by an analysis controlling unit 40. Functional blocks of the analysis controlling unit 40 include a normal analysis execution controlling unit 41 and a radio-frequency voltage scanning table storage unit 42. An input unit 44 receives an operation by the user, and a main controlling unit 43 is in charge of overall control of a user interface and the apparatus as a whole.

The analysis controlling unit 40, the main controlling unit 43, and the data processing unit 30 are entirely or partially implemented with a personal computer, which is a physical entity, executing dedicated control/processing software installed in the computer.

In the Q-TOF mass spectrometer of the present embodiment, the MS/MS analysis can be performed by dissociating the ions in the collision cell 13. Furthermore, as described above, the $MS^1$ analysis without the dissociation of the ions in the collision cell 13 can also be performed. The Q-TOF mass spectrometer of the present embodiment performs characteristic control and processing when performing the normal $MS^1$ analysis. Operations in the characteristic control and processing operations will be described below with reference to FIGS. 2 and 3.

FIGS. 2A-2B are diagrams illustrating an example of a radio-frequency voltage scanning table in FIG. 1. FIG. 3 is a schematic view illustrating a relationship between the setting m/z and a radio-frequency voltage parameter in the Q-TOF mass spectrometer of the present embodiment. In addition, for the purpose of comparison with these FIGS. 2A-2B and FIG. 3, FIGS. 4A-4B and FIG. 5 are provided that respectively illustrate an example of a radio-frequency voltage scanning table used in a conventional Q-TOF mass spectrometer and illustrate a relationship between setting m/z and a radio-frequency voltage parameter in the conventional Q-TOF mass spectrometer.

When the normal analysis is performed, the quadrupole mass filter 12 transports the ions to the subsequent stage while focusing the ions by means of a radio-frequency electric field. Thus, like the ion guides 9, 11 and 14, the quadrupole mass filter 12 substantially serves as an ion guide using a radio-frequency electric field. Therefore, the ions derived from the sample component generated by the ion source pass through the four ion guides (the array type ion guide 9, the multipole type ion guide 11, the quadrupole mass filter 12, and the ion guide 14) to be introduced into the orthogonal acceleration unit 17. Any ion guide that uses a radio-frequency electric field imposes a limit to the mass-to-charge ratio range of the ions passing through. For the sake of simplicity of explanation, the array type ion guide 9 and the multipole type ion guide 11 are collectively regarded as one ion guide A, the quadrupole mass filter 12 is regarded as an ion guide B, and the ion guide 14 is regarded as an ion guide C.

Figure 5:
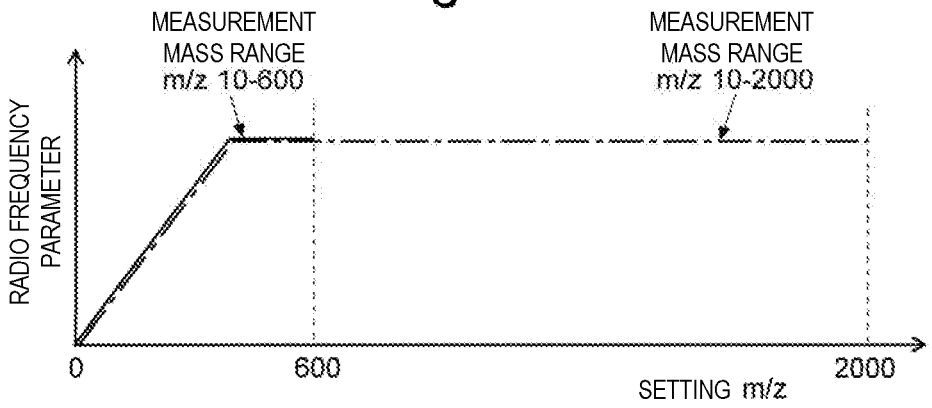
FIG. 5 is a schematic view illustrating a relationship between setting m/z and a radio-frequency voltage parameter in the conventional Q-TOF mass spectrometer.
Figure 6:
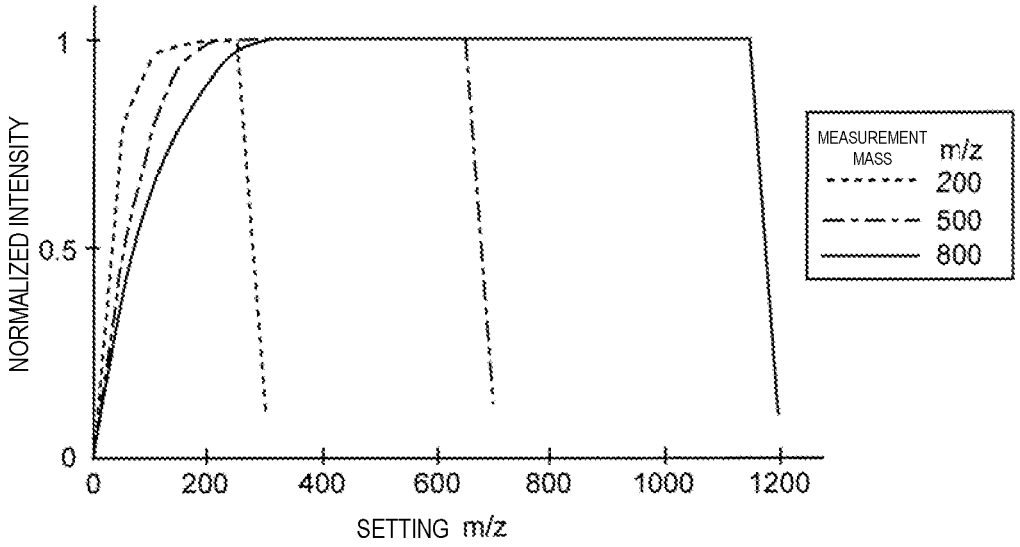
FIG. 6 is a schematic diagram illustrating normalized values of the intensities of measurement target ions with the respective mass-to-charge ratios of m/z 200, m/z 500, and m/z 800 for passing through an ion guide, relative to the setting m/z.

Now, a case will be described where a summarized mass spectrum is acquired for two mass ranges with m/z 10 to 600 and with m/z 10 to 2000. As illustrated in FIGS. 4A-4B, in the radio-frequency voltage scanning table in the conventional apparatus, the radio-frequency parameter (a relative value of the parameter that determines the amplitude of the radio-frequency voltage) does not change depending on the mass range, as long as the setting m/z is the same. Therefore, as illustrated in FIG. 5, the relationship between the setting m/z and the radio-frequency parameter in the mass-to-charge ratio range of m/z 10 to 600 is exactly the same between the mass range m/z 10 to 2000 and the mass range m/z 10 to 600. Furthermore, the radio-frequency parameter is constant in a range m/z 600 to 2000 in the mass range m/z 10 to 2000.

On the other hand, in the radio-frequency voltage scanning table in the Q-TOF mass spectrometer of the present embodiment, as illustrated in FIGS. 2A-2B, the entire mass-to-charge ratio range of each of the mass range m/z 10 to 600 and the mass range m/z 10 to 2000 is divided into six approximately equal sections. The mass-to-charge ratio at the boundaries among the six sections is defined as the setting m/z. The same radio-frequency parameter value is set for the setting m/z at the boundaries of the corresponding sections of different mass ranges. Specifically, for example, the same radio-frequency parameter value is set for the setting m/z 1000 in the mass range m/z 10 to 2000 and the setting m/z 300 in the mass range m/z 10 to 600. Therefore, as illustrated in FIG. 3, in both the mass range m/z 10 to 2000 and the mass range m/z 10 to 600, the relationship between the radio-frequency voltage and a position on an axis between the upper and lower limits of the mass range is substantially the same. In other words, a line graph indicating the relationship between the setting m/z and the radio-frequency parameter in the mass range m/z 10 to 2000 is of a shape obtained by directly extending, in a lateral direction (direction of an axis representing a mass-to-charge ratio), a line graph indicating the relationship between the setting m/z and the radio-frequency parameter in the mass range m/z 10 to 600.

Before the normal mass spectrometry is implemented, the user designates the observation target mass range using the input unit 44. Although there are only two types of mass ranges in FIGS. 2 and 3, more types of mass ranges may be prepared beforehand. The normal analysis execution controlling unit 41 acquires the radio-frequency parameter table corresponding to the designated mass range(s) from the radio-frequency voltage scanning table storage unit 42, and determines the radio-frequency voltage applied to the ion guides A, B, and C based on the acquired table.

Figure 7A:
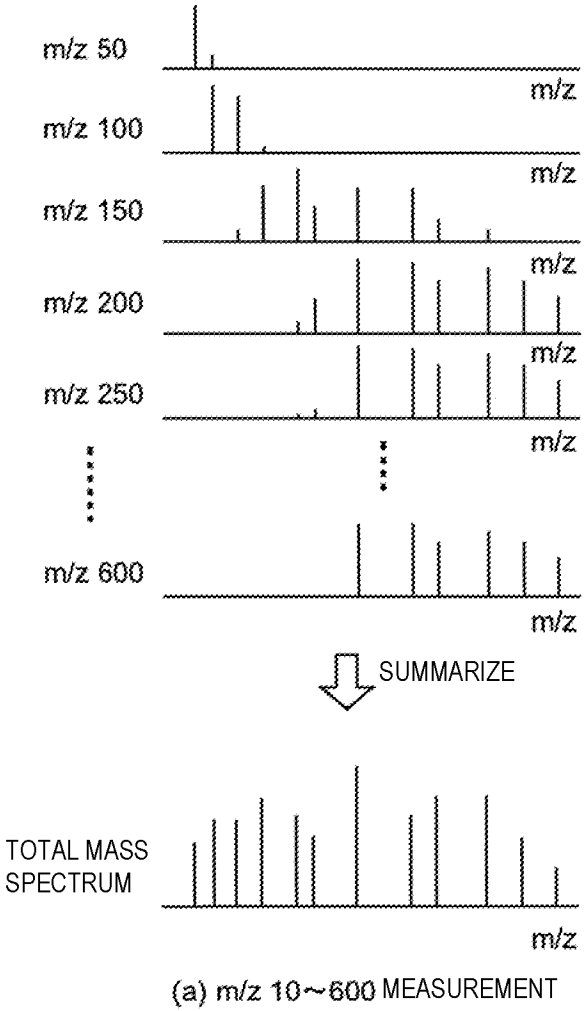
FIGS. 7A-7B illustrate relationship between a mass spectrum obtained by each time of measurement and a summarized mass spectrum, in a case where a mass spectrum is obtained with a mass range of m/z 10 to 600 and a case where a mass spectrum is obtained with a wider mass range of m/z 10 to 2000.
Figure 7B:
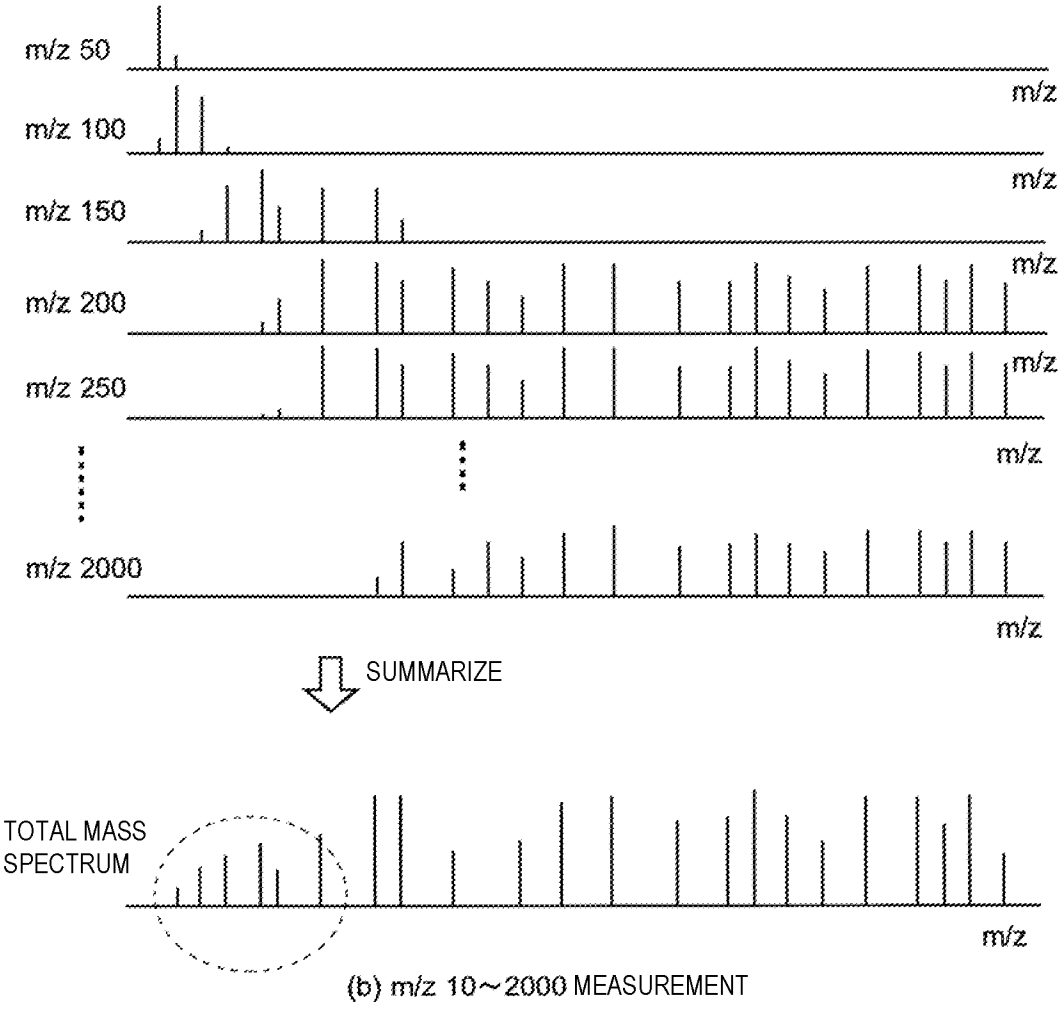

Thus, the normal analysis execution controlling unit 41 sets the setting m/z to be increased by a predetermined mass-to-charge ratio (for example, m/z 50 at a time as in the example illustrated in FIGS. 7A-7B) within the mass-to-charge ratio range of the designated mass range, acquires the radio-frequency parameter value corresponding to the setting m/z from the radio-frequency parameter table, and controls the voltage generating units 21 to 24 to apply the radio-frequency voltage based on the acquired radio-frequency parameter value to the ion guides A, B, and C. Note that, as a general practice, the radio-frequency parameter value corresponding to the setting m/z not included in the radio-frequency parameter table may be obtained by a method such as linear interpolation.

Ions derived from sample components are measured while the radio-frequency voltage corresponding to one setting m/z being applied to each of the ion guides A, B, and C, and the data collection unit 31 stores mass spectrum data obtained by the measurement. The normal analysis execution controlling unit 41 repeats the same measurement while changing the setting m/z step by step, that is, while changing the radio-frequency voltage applied to the ion guides A, B, and C. Then, measurement is performed for each of a plurality of settings m/z over the entire mass-to-charge ratio range of the mass range, and then the measurement is terminated.

When the setting m/z is changed by m/z 50 at a time as illustrated in FIGS. 7A-7B, a change in the radio-frequency voltage in the case of the mass range m/z 10 to 2000 in the apparatus according to the present embodiment is moderate compared with a change in the radio-frequency voltage in the case of the mass range m/z 10 to 2000 in the conventional apparatus, as is clear from the comparison between FIG. 3 and FIG. 5. Therefore, with the apparatus according to the present embodiment, a large amount of mass spectrum data under a condition with a substantially high ion detection sensitivity is collected in the low mass-to-charge ratio region, when the mass range is wide. The mass spectrum summarizing processing unit 32 summarizes mass spectrum data pieces corresponding to a plurality of times of measurement obtained for the entire mass range, with the mass spectrum data pieces generally featuring a high ion intensity in the low mass-to-charge ratio region as described above. Thus, monitoring of the peak in the low mass-to-charge ratio region is facilitated with the mass spectrum as a result of the summarizing processing.

As described above, with the Q-TOF mass spectrometer according to the present embodiment, a mass spectrum with sufficiently high sensitivity in the low mass-to-charge ratio region can be obtained even when the mass range is wide. Furthermore, the peak pattern corresponding to the same mass-to-charge ratio range is less likely to be different between cases where the mass range is wide and narrow. This facilitates comparison between mass spectra obtained with different mass ranges.

It should be noted that the numerical values used in the above embodiment, such as the numerical values in the table illustrated in FIGS. 2A-2B and the relationship between the setting m/z and the radio-frequency parameter value, are merely examples.

Further, the above described embodiment is about applying the present invention to the Q-TOF mass spectrometer capable of implementing MS/MS analysis. The present invention can also be applied to mass spectrometers such as an OA-TOFMS capable of implementing normal mass spectrometry only.

The embodiments described above are examples of the present invention, and thus modification, correction, addition, and the like to the embodiments without departing from the gist of the present invention are apparently included in the scope of the claims of the present application.

REFERENCE SIGNS LIST

1 . . . Chamber
2 . . . Ionization Chamber
3 . . . First Intermediate Vacuum Chamber
4 . . . Second Intermediate Vacuum Chamber
5 . . . First Analysis Chamber
6 . . . Second Analysis Chamber
7 . . . ESI Spray
8 . . . Heating Capillary
9 . . . Array Type Ion Guide
10 . . . Skimmer
11 . . . Multipole Type Ion Guide
12 . . . Quadrupole Mass Filter
13 . . . Collision Cell
14 . . . Ion Guide
15 . . . Ion Passage Port
16 . . . Ion Transport Optical System
17 . . . Orthogonal Acceleration Unit
18 . . . Flight Space
19 . . . Reflector
20 . . . Ion Detector
30 . . . Data Processing Unit
31 . . . Data Collection Unit
32 . . . Mass Spectrum Summarizing Processing Unit
40 . . . Analysis Controlling Unit
41 . . . Normal Analysis Execution Controlling Unit
42 . . . Radio-frequency Voltage Scanning Table Storage Unit
43 . . . Main Controlling Unit
44 . . . Input Unit
C . . . Ion Optical Axis

The invention claimed is:

1. A time-of-flight mass spectrometer including an ion source for ionizing a sample component, a time-of-flight mass spectrometry unit including an ion ejecting unit for ejecting ions generated by the ion source or other ions derived from the generated ions into a flight space, and one or a plurality of ion transport optical elements for transporting the ions while focusing the ions by means of a radio-frequency electric field, the one or plurality of ion transport optical elements being provided between the ion source and the ion ejecting unit, the time-of-flight mass spectrometer comprising:

a) a voltage generating unit for applying radio-frequency voltage for forming the radio-frequency electric field to each of the one or plurality of ion transport optical elements;

b) a controlling unit for determining, in response to a mass range designated as an observation target, a radio-frequency voltage applied to each of the one or plurality of ion transport optical elements in each of a plurality of times of measurement using different measurement target mass-to-charge ratio ranges for acquiring a mass spectrum entirely covering a mass-to-charge ratio range of the mass range, and for controlling components to perform the plurality of times of measurement while changing the radio-frequency voltage applied to each of the one or plurality of ion transport optical elements by the voltage generating unit, the controlling unit determining the radio-frequency voltage for each of the plurality of times of measurement to maintain a ratio of times of measurement in which radio-frequency voltage is set so that ion passage efficiency in a low mass-to-charge ratio region is relatively high among the plurality of times of measurement to be substantially constant regardless of a width of the mass range; and c) a mass spectrum summarizing processing unit for obtaining a mass spectrum corresponding to the mass range by summarizing mass spectrum data pieces obtained by the plurality of respective times of measurement under control by the controlling unit.

2. The time-of-flight mass spectrometer according to claim 1, wherein the controlling unit determines the radio-frequency voltage based on a table or a formula in which a relationship between a position on an axis between upper and lower limits of the mass range and the radio-frequency voltage is substantially same between different mass ranges.

3. The time-of-flight mass spectrometer according to claim 2, wherein a quadrupole mass filter capable of selectively allowing ions with a certain mass-to-charge ratio to pass through and a collision cell for dissociating the ions are provided between the ion source and the ion ejecting unit, and the quadrupole mass filter operating without selecting the ions and an ion guide provided in the collision cell collectively serve as one of the one or plurality of ion transport optical elements.

4. The time-of-flight mass spectrometer according to claim 1, wherein a quadrupole mass filter capable of selectively allowing ions with a certain mass-to-charge ratio to pass through and a collision cell for dissociating the ions are provided between the ion source and the ion ejecting unit, and the quadrupole mass filter operating without selecting the ions and an ion guide provided in the collision cell collectively serve as one of the one or plurality of ion transport optical elements.

5. The time-of-flight mass spectrometer according to claim 4, wherein one or a plurality of ion guides provided between the ion source and the quadrupole mass filter serve as the one or plurality of ion transport optical elements.

* * * * *